US005842543A

United States Patent [19]

Naito et al.

[11] Patent Number: 5,842,543

[45] Date of Patent: Dec. 1, 1998

[54] LUBRICANT SUPPLY APPARATUS FOR RAILROAD TURNOUT

[75] Inventors: Hiroyuki Naito, Kyoto; Masao Omori, Hyogo-ken, both of Japan

[73] Assignee: Nabco Limited, Kobe, Japan

[21] Appl. No.: 736,005

[22] Filed: Oct. 23, 1996

[30] Foreign Application Priority Data

Oct. 24, 1995 [JP] Japan ..... 7-275843

[51] Int. Cl.[6] ..... B61K 3/00

[52] U.S. Cl. ..... 184/3.1; 184/6.4; 184/108

[58] Field of Search ..... 184/3.1, 3.2, 6.4, 184/6, 108

[56] References Cited

U.S. PATENT DOCUMENTS

| | | | |
|---|---|---|---|
| 4,537,285 | 8/1985 | Brown et al. | 184/6.4 |
| 4,787,479 | 11/1988 | Ostermeyer et al. | 184/7.2 |
| 4,856,617 | 8/1989 | Lounsberry III et al. | 184/3.1 |
| 5,182,720 | 1/1993 | Beck et al. | 184/108 |
| 5,244,350 | 9/1993 | Yang | 184/108 |
| 5,381,874 | 1/1995 | Hadank et al. | 184/6.4 |

FOREIGN PATENT DOCUMENTS

| | | |
|---|---|---|
| SHO 53-17208 | 6/1978 | Japan . |

*Primary Examiner*—Thomas E. Denion
*Attorney, Agent, or Firm*—Duane, Morris & Heckscher LLP

[57] ABSTRACT

A lubricant supply apparatus includes a pump for discharging lubricant. The lubricant is supplied onto two rows of floor plates arranged on a row of ties. Two tongue rails are mounted on the two rows of floor plates in such a manner as to slide on the floor plates. Times at which the pump is to start operating are preset in a schedule timer. The schedule timer informs a lubricant supply timer when the pump should start operating.

7 Claims, 7 Drawing Sheets

LUBRICANT SUPPLY APPARATUS FOR RAILROAD TURNOUT

This invention relates to a lubricant supply apparatus for supplying lubricant to a railroad turnout.

BACKGROUND OF THE INVENTION

In a railroad turnout, a pair of stock rails are arranged on respective ones of a pair of rows of floor plates. Inward of the respective stock rails, a pair of tongue rails are disposed on the rows of floor plates. The turnout switches the positions of the tongue rails between one state in which one tongue rail engages with one stock rail with the other tongue rail separated from the other stock rail, and another state in which the one tongue rail is disengaged from the one stock rail with the other tongue rail engaging with the other stock rail. The switching of the tongue rails determines the direction in which a vehicle can move. In order for the tongue rails to be able to move smoothly, a lubricant supply apparatus is provided for the turnout to supply lubricant to the floor plates.

An example of such lubricant supply apparatus is disclosed in Japanese Examined Patent Publication (KOKOKU) No. SHO 53-17208 published on Jun. 7, 1978. The lubricant supply apparatus disclosed in this publication includes a lubricant supply pump which supplies lubricant through lubricant supply tubing to interfaces between the tongue rails and floor plates. The sliding of the tongue rails is detected by a detector which develops an output upon detection of the sliding, and the number of occurrence of outputs from the detector is counted by a counter. When the count reaches a predetermined value, the lubricant supply pump is activated.

In case that the tongue rails slide at long intervals and rain falls during a time period between one slide to another of the tongue rails, lubricant on the floor plates may be washed away and, therefore, an insufficient amount of lubricant is left on the floor plates when the tongue rails are operated to slide on the floor plates.

Therefore, an object of the present invention is to provide a lubricant supply apparatus which can supply lubricant to floor plates at appropriate times.

Another object of the present invention is to provide a lubricant supply apparatus including lubricant supply tubing which can be mounted in a simple manner.

SUMMARY OF THE INVENTION

A lubricant supply apparatus according to the present invention supplies lubricant between at least one row of a plurality of spaced apart floor plates and at least one tongue rail. The tongue rails are mounted on the floor plates in such a manner as to be capable of sliding on the floor plates. The lubricant supply apparatus includes a lubricant supply pump which discharges lubricant, and first timer means which sets a pump operation start time at which the operation of the pump is started. Second timer means of the lubricant supply apparatus is responsive to the output of the first timer means to operate the lubricant supply pump for a predetermined time period.

The first timer means may set a plurality of pump operation start times.

The first timer means may set the pump operation start times at times when the tongue rails are to slide.

The first timer means may set the pump operation start times at different times than the times when the tongue rails are to slide.

The first timer means may set the pump operation start times at times immediately before the tongue rails are to slide.

The first timer means may set the pump operation start times at times immediately after the tongue rails are to slide.

The lubricant supply apparatus may include a battery for operating the first timer means.

A lubricant feeding tube holding structure according to the present invention includes tube holders. Each tube holder has a base extending upward along a surface of each of a plurality of spaced apart ties. From the top end of each base, a top piece extends along the top surface of each tie, and a holding piece is provided at the lower end of each base. The holding piece holds a lubricant feeding tube through which lubricant is fed from the lubricant supply pump.

The mounting structure also includes tube top end fixing members. Each fixing member has a horizontal piece disposed along the top surface of each tie. A vertical piece extends upward from one end of the horizontal piece. A tip end of each lubricant feeding tube is fixed to the vertical piece.

DETAILED DESCRIPTION OF EMBODIMENT

Figure 1:
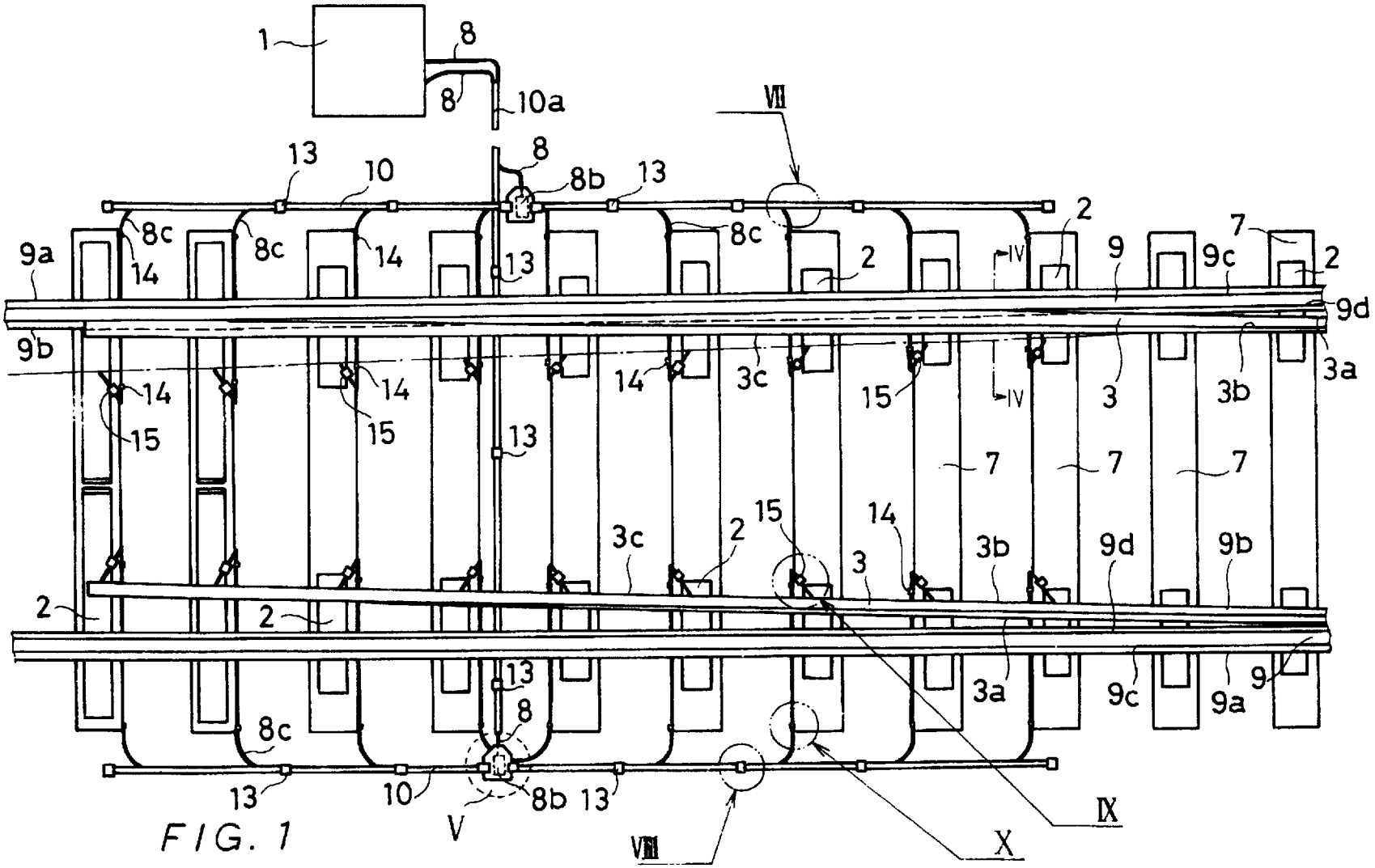
FIG. 1 is a plan view of a railroad turnout with a lubricant supply apparatus according to the present invention.

Referring to FIG. 1, a railroad turnout includes a plurality of equally spaced parallel ties 7. A pair of floor plates 2 are arranged on the top surface of the opposite ends of each tie 7. Thus, the floor plates 2 are arranged in two rows on the ties 7. The floor plates 2 are, for example, rectangular steel plates.

Figure 4:
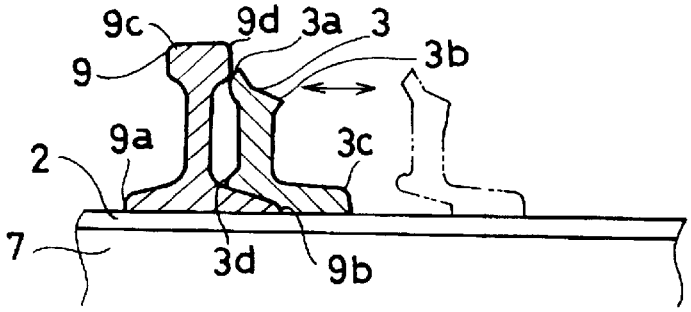
FIG. 4 is a cross-sectional view along the line IV—IV in FIG. 1.

A pair of stock rails 9 are secured substantially in parallel on the two rows of floor plates 2. As shown in FIG. 4, each of the stock rails 9 has a generally I-shaped cross-section.

The side edges 9*a* and 9*b* of the upper horizontal bar of the I-shape of the rail 9 are located inward of the side edges 9*c* and 9*d* of the lower horizontal bar.

A pair of tongue rails 3 are disposed on respective ones of the two rows of floor plates 2. The tongue rails 3 are disposed inward of the associated stock rails 9. As shown in FIG. 4, each of the tongue rails 3 has a generally L-shaped cross-section. The distance between the top side edges 3*a* and 3*b* of each tongue rail 3 decreases toward the tip end, as shown in FIG. 1, but the distance between the side edges 3*c* and 3*d* of the bottom is substantially constant. The tongue rails 3 can slide to reciprocate on the floor plates 2 so as to engage with or disengage from the associated stock rails 9, as shown in FIG. 4. With one tongue rail 3 engaging with its associated stock rail 9, the other tongue rail 3 is spaced from the other stock rail. When each of the tongue rails 3 is disengaged from the associated stock rail 9 by a driving apparatus (not shown), as indicated by a phantom line in FIG. 1, that tongue rail 3 forms an angle with the associated stock rail 9, and the other tongue rail 3 comes into engagement with the other stock rail 9.

A lubricant supply apparatus 1 according to the present invention supplies lubricant to interfaces between the floor plates 2 and each tongue rail 3. As shown in FIG. 1, the lubricant supply apparatus 1 is disposed on one side of one of the stock rails 9. As shown in detail in FIG. 2, the lubricant supply apparatus 1 has a casing 1*a*. A lid 1*e* on top of the casing 1*a* closes the casing 1*a*, and the bottom of the casing 1*a* is secured to fixing members 17. The interior of the casing 1*a* is divided into upper and lower regions 18 and 19 by a partition wall 21 indicated by phantom lines in FIG. 3. A lubricant supply pump 4 is disposed within the casing 1*a*.

The lubricant supply pump 4 has a reservoir 4*d* (indicated by broken lines in FIG. 2) which is disposed in the lower region 19 and contains lubricant, e.g. grease. A motor 4*c* is disposed in the upper region 18 and pumps up the lubricant from the reservoir 4*d* to a supply port 4*e* disposed in the upper region 18. The lubricant pumped up into the supply port 4*e* is supplied to a distributing valve 8*a* which is also disposed in the upper region 18. The reservoir 4*d* is replenished with the lubricant through a replenishing port 4*f* located in the upper region 18.

Figure 2:
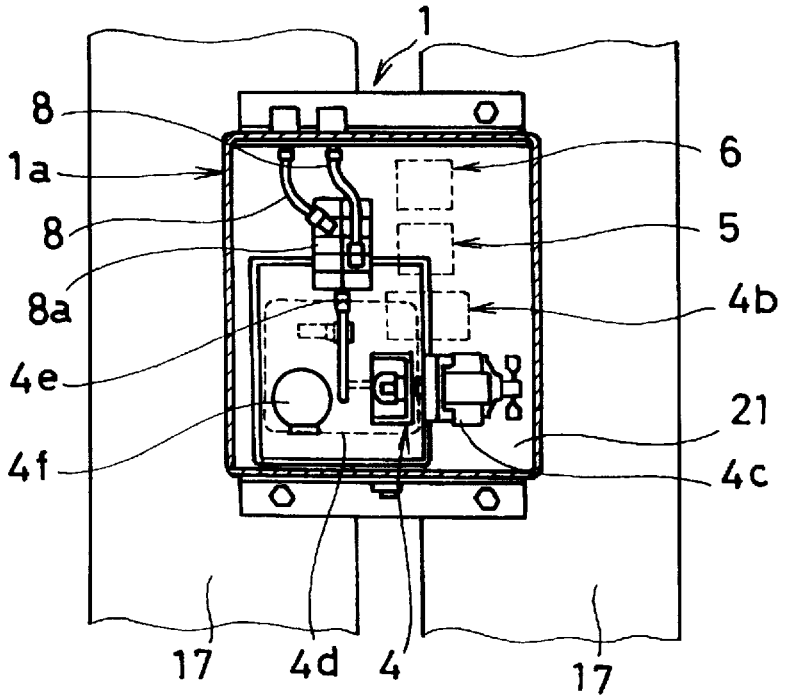
FIG. 2 is a cross-sectional view along the line II—II in FIG. 3.
Figure 3:
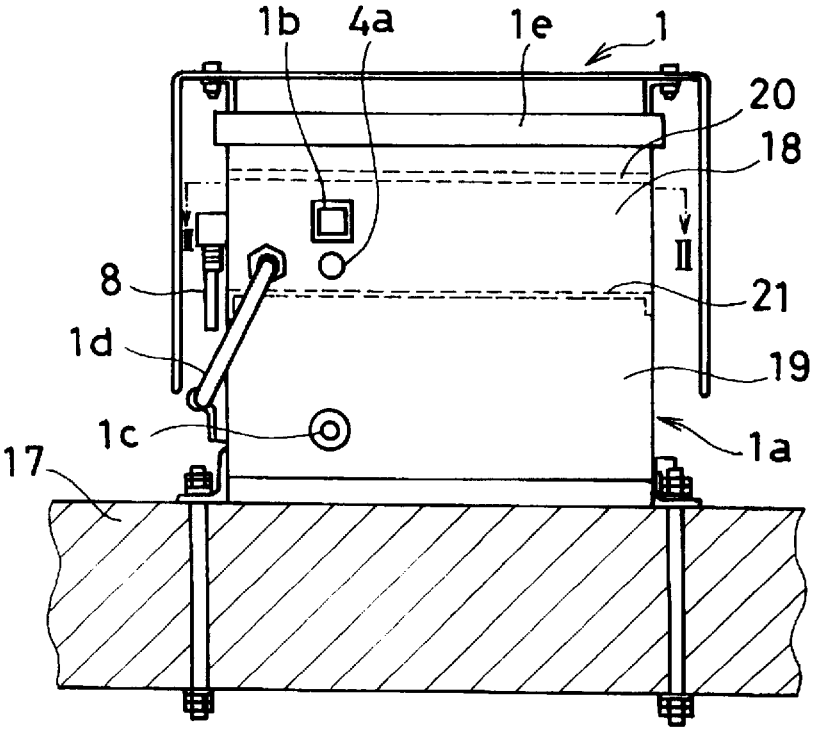
FIG. 3 is a side view of the lubricant supply apparatus shown in FIG. 1.

A control panel 20, indicated by a phantom lines in FIG. 3, is disposed in the upper region 18. First timer means, e.g. a schedule timer 5 (indicated by double-dot-and-dash lines in FIG. 2) is disposed on the control panel 20. The schedule timer 5 stores in it a plurality of pump operation start times at which the lubricant supply pump 4 is to start operating. Second timer means, e.g. a lubricant supply timer 6 (indicated by double-dot-and-dash lines in FIG. 2) is also disposed on the control panel 20. The lubricant supply timer 6 is responsive to an output of the schedule timer 5 to cause the lubricant supply pump 4 to operate for a predetermined time period, e.g. for a lubricant supply time period during which lubricant is supplied to the floor plates. For example, when the schedule timer 5 tells the lubricant supply timer 6 when the lubricant supply pump operation start time comes, the timer 6 supplies the lubricant supply pump 4 with AC power to operate it for the lubricant supply time period. The lubricant supply time period and the respective pump operation start times are variable.

The motor 4*c*, the schedule timer 5, and the lubricant supply timer 6 are driven from an AC power supply. The AC power supply may be provided through a supply line 1*d* shown in FIG. 3.

The control panel 20 includes also a leakage detecting circuit breaker 4*b* with a power supply switch, which is indicated by double-dot-and-dash lines in FIG. 2. The circuit breaker 4*b* is normally closed to conduct AC power therethrough. When the circuit breaker 4*b* detects leakage, it is opened or turned off so as to decouple the AC power. The schedule time 5 includes a battery (not shown) which enables the schedule timer 5 to continue to operate even when AC power is interrupted for some reason.

A power supply indicator lamp 1*b* which indicates that power is being supplied is disposed on one side surface of the casing 1*a*. The casing 1*a* has also a lubricant level indicating window 1*c* on the side surface thereof, which indicates that the lubricant in the reservoir 4*d* is at the level of the window 1*c*. An operation check button switch 4*a* is also disposed on the side surface of the casing 1*a*. When a maintenance man pushes the operation check button switch 4*a*, the lubricant supply pump 4 is energized to operate so that the maintenance man can determine whether the pump 4 can operate normally. Also, this button switch 4*a* can be used to operate the pump 4 to supply the lubricant at any time when it is found that the lubricant on the floor plates 2 is insufficient.

Figure 14:
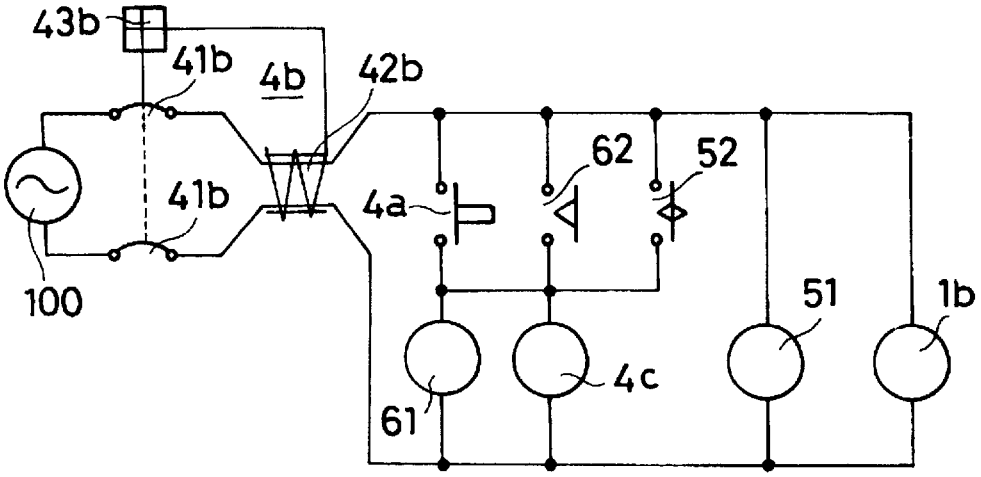
FIG. 14 is an electrical circuit diagram of the lubricant supply apparatus of FIG. 1.

FIG. 14 is an electrical circuit diagram of the lubricant supply apparatus 1. The leakage detecting circuit breaker 4*b* includes a pair of contacts 41*b*, a leakage detector 42*b*, and a driver 43*b* for driving the contacts 41*b*. When the leakage detector 42*b* detects current leakage, the contact driver 43*b* opens the contacts 41*b*. An AC voltage from an AC power supply 100 is applied to a driver 51 of the schedule timer 5 through the contacts 41*b* and the leakage detector 42*b* of the leakage detecting circuit breaker 4*b*.

The driver 51 of the schedule timer 5 with an AC voltage being supplied thereto continuously keeps time, and when each preset pump operation start time comes, a contact 52 of the schedule timer 5 is closed, so that the AC voltage is applied to a driver 61 of the lubricant supply timer 6. As a result, a contact 62 of the lubricant supply timer 6 is closed. At the same time, the contact 52 of the schedule timer 5 is opened. Although the contact 52 is opened, the supply of the AC voltage to the driver 61 of the lubricant supply timer 6 is continued through the closed contact 62. With the contact 62 closed, the AC voltage is supplied to the motor 4*c* to rotate it. As a result, lubricant pumped up from the reservoir 4*d* is fed to the distributing valve 8*a*. When a predetermined lubricant supply time period has lapsed, the driver 61 of the lubricant supply timer 6 opens its contact 62, so that the application of the AC voltage to the motor 4*c* is stopped. The motor 4*c* stops rotating and the feed of lubricant to the distributing valve 8*a* is stopped.

When the button switch 4*a* is closed, the AC voltage is applied to the driver 61 of the lubricant supply timer 6, and lubricant is fed to the distributing valve 8*a* for the predetermined lubricant supply time period in the same manner as described above.

The power supply indicator lamp 1*b* is connected in parallel with the driver 51 of the schedule timer 5, and emits light to indicate when the AC voltage is being supplied to the driver 51.

The distributing valve 8*a* supplied with the lubricant by the lubricant supply pump 4 distributes the lubricant to two branches. Two lubricant feeding tubes 8 made of, for example, nylon, indicated by thicker lines in FIG. 1, are connected to two output ports of the distributing valve 8*a*. The other ends of the two lubricant feeding tubes 8 are connected to respective ones of two subsidiary distributing valves 8*b* which are disposed outward of the respective stock rails 9. The two lubricant feeding tubes 8 are connected to the respective subsidiary distributing valves 8*b* through a bellows tube 10*a* similar to bellows tubes 10 which will be described later.

Figure 5:
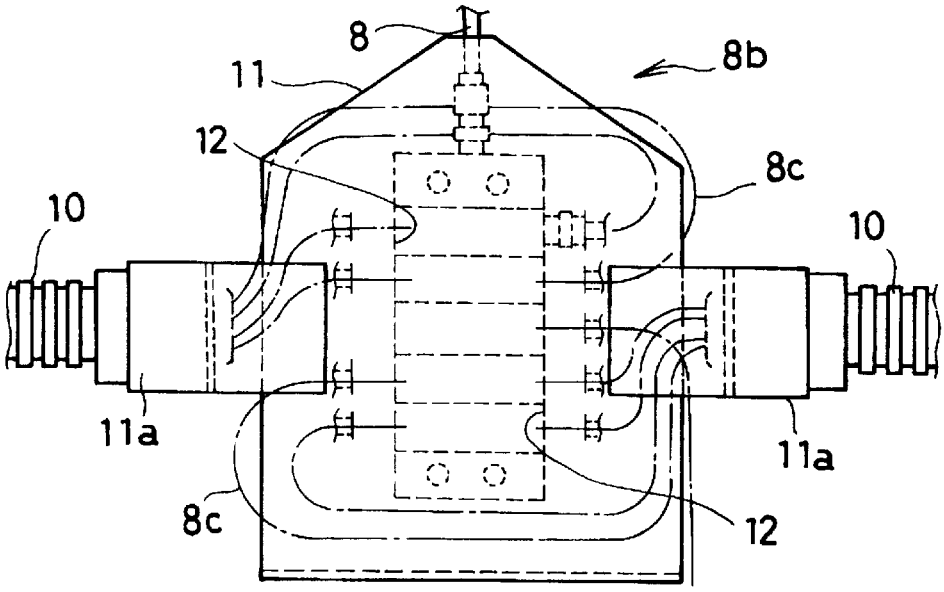
FIG. 5 is an enlarged plan view of the portion encircled by a broken line circle V in FIG. 1.
Figure 6:
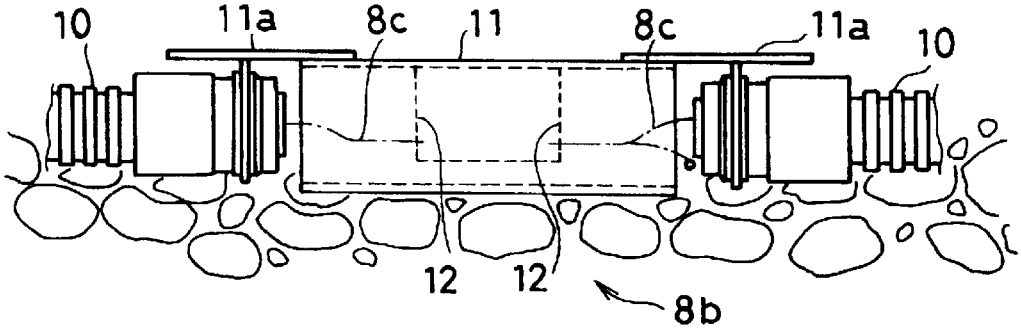
FIG. 6 is an enlarged front view of the portion encircled by the broken line circle V in FIG. 1.
Figure 7:
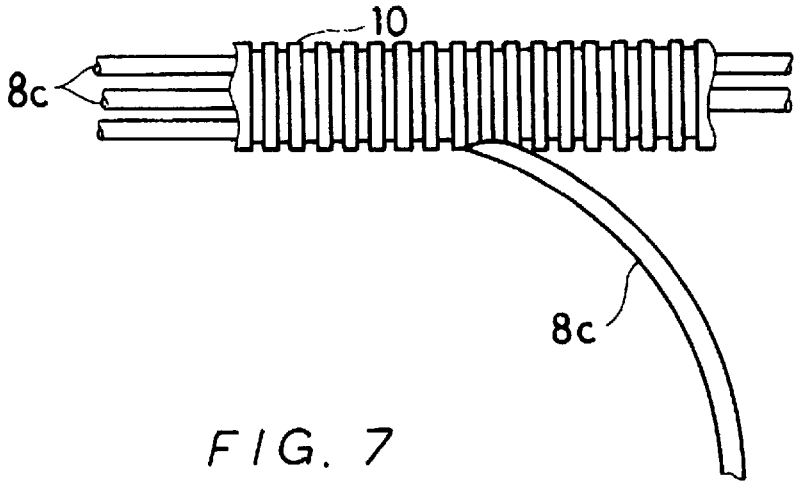
FIG. 7 is an enlarged plan view of the portion encircled by a broken line circle VII in FIG. 1.

As shown in FIGS. 5 and 6, the subsidiary distributing valves 8*b* are disposed in respective casings 11. Each of the subsidiary distributing valves 8*b* outputs the lubricant supplied thereto through the lubricant feeding tube 8 from a plurality, nine in the illustrated embodiment, of outlet ports 12 which are formed in the sides of the valve 8*b*. Each of the outlet ports 12 is connected to one end of each of terminal lubricant feeding tubes 8*c*. About one half of the terminal tubes 8*c* are placed in one of two bellows tubes 10 and the remaining ones are placed in the other bellows tube 10. The terminal tubes 8*c* are taken out of the bellows tubes 10 in a manner as shown in FIG. 7, at locations near the respective floor plates 2, as shown in FIG. 1. In FIG. 1, the terminal lubricant feeding tubes 8*c* are indicated by thicker lines. Each of the bellows tubes 10 has its one end fixed to one of projections 11*a* which project in opposite directions from the top portion of each casing 11, as shown in FIG. 6.

Figure 8:
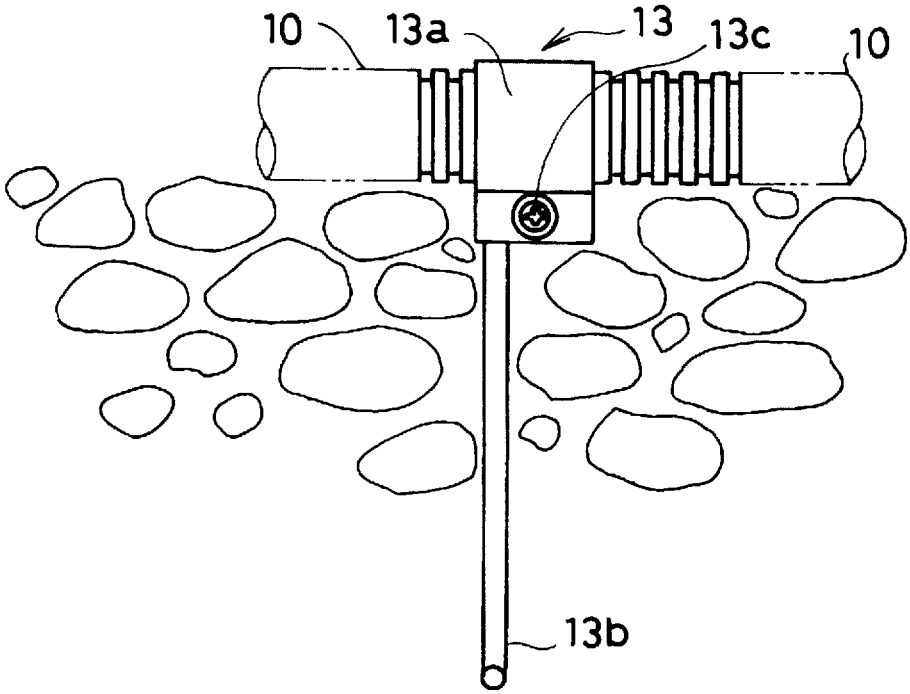
FIG. 8 is an enlarged front view of the portion encircled by a broken line circle VIII in FIG. 1.
Figure 9:
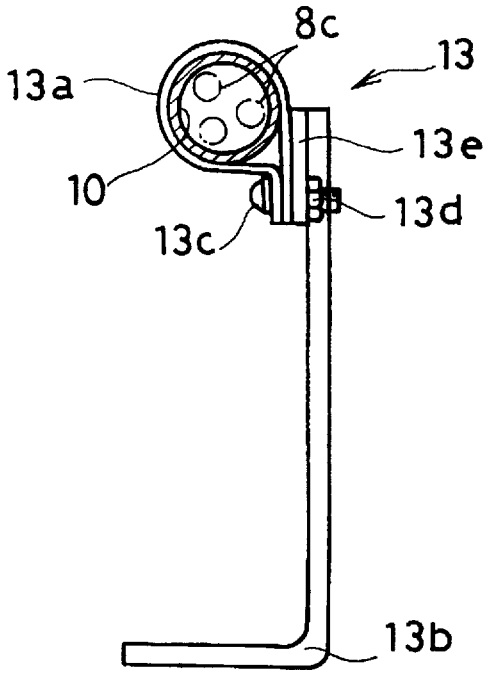
FIG. 9 is an enlarged side view of the portion encircled by the broken line circle VIII in FIG. 1.

The bellows tubes 10 and 10*a* are securedly held by a plurality of fixing devices 13 which are fixed to the ground at intervals. As shown in FIGS. 8 and 9, each of the fixing devices 13 includes a generally cylindrical member 13*a* formed by bending a plate. The bellows tube 10 or 10*a* extends through the loop of the member 13*a*. One edge portion of the plate is bent outward and placed on the other edge portion. An L-shaped rod 13*b* with a small plate 13*e* secured to its one end is secured to the cylindrical member 13*a* by a bolt 13*c* and a nut 13*d*. The bolt 13*c* extends through the overlapping edge portions of the cylindrical member 13*a* and the plate 13*e*. The fastening of the bellows tube 10 or 10*a* to the cylindrical member 13*a* can be adjusted by the bolt 13*c* and the nut 13*d*. The shorter leg of the L-shaped rod 13*b* is embedded in the ground, so that the bellows tube 10 or 10*a* can be securedly held in the ground.

Figure 10:
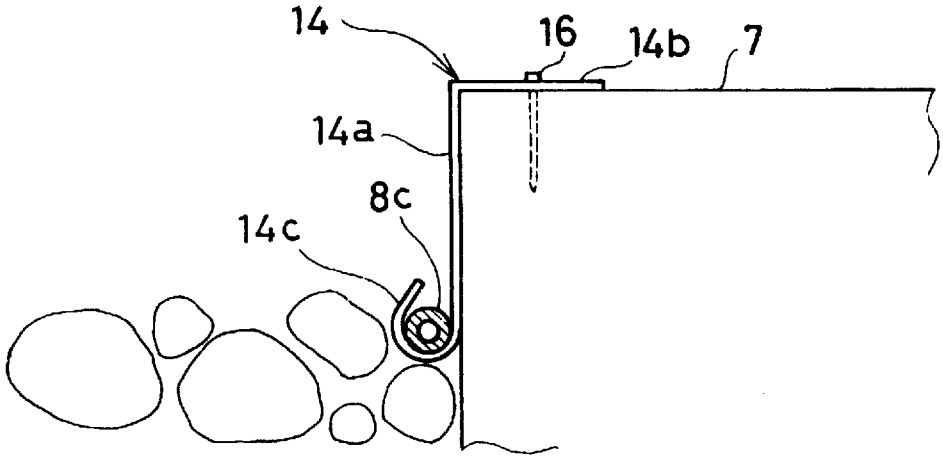
FIG. 10 is an enlarged view of the portion encircled by a broken line circle X in FIG. 1.

As shown schematically in FIG. 1, each of the terminal tubes 8*c* is fixed to one of the ties 7 at a plurality, two in the illustrated embodiment, of locations by tube holders 14. Each tube holder 8*c*, which is shown in detail in FIG. 10, includes a planar base 14*a*. The base 14*a* extends upward along an outer side surface, e.g. a long side surface, of a tie 7. A planar top piece 14*b* extends from the top end of the base 14*a* along the top surface of the tie 7. Thus, the base 14*a* and the top piece 14*b* form an L-shaped member. The top piece 14*b* is fixed by a nail 16 to the tie 7. The lower end portion of the base 14*a* is bent outward to form a generally U-shaped holding portion 14*c*. The terminal lubricant feeding tube 8*c* is placed in the space between the two legs of the U-shaped holding portion 14*c*, so that the tube 8*c* extends along the length of the tie 7 and is fixed relative to the tie 7.

Figure 11:
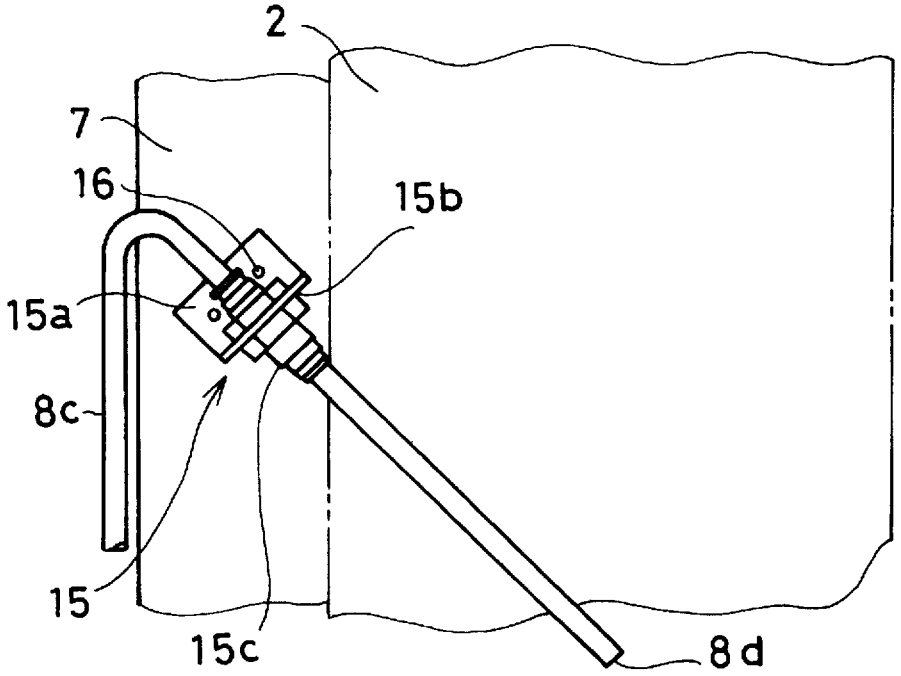
FIG. 11 is an enlarged view of the portion encircled by a broken line circle XI in FIG. 1.
Figure 12:
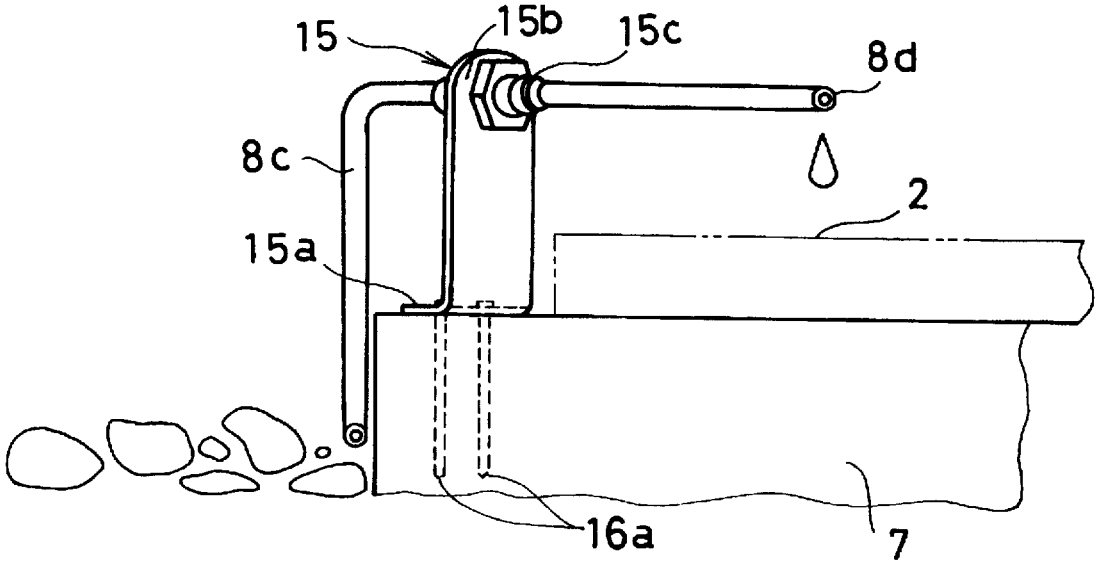
FIG. 12 is an enlarged front view of the portion encircled by the broken line circle XI in FIG. 1.

The tip end of of each terminal lubricant feeding tubes 8*c* is fixed to one of the ties 7 at a location near the position that one of the tongue rails 3 assumes when it is separated from and forms an angle with its associated stock rail 9, as shown in FIG. 1. The tip end is fixed with a tube tip end fixing member 15. The tip end fixing member 15 is shown in detail in FIGS. 11 and 12. The tip end fixing member 15 has a planar horizontal piece 15*a* disposed along the top surface of the tie 7. A planar vertical piece 15*b* extends upward at a generally right angle from one end of the horizontal piece 15*a*. The horizontal piece 15*a* is fixed to the tie 7 with nails 16*a* so as to fix the tip end fixing member 15 to the tie 7. A cylindrical member 15*c* is attached to the tip end of the vertical piece 15*c*, and the tip end portion of the terminal lubricant feeding tube 8*c* is inserted into and secured by the cylindrical member 15*c*.

The bellows tubes 10 and 10*a* and the terminal lubricant feeding tubes 8*c* are secured by the embedded fixing members 13, the tube holders 14, and the tip end fixing members 15 in the following manner.

First, the two lubricant feeding tubes 8 are inserted into the bellows tube 10*a* from its one end. The bellows tube 10*a* extends from a location outside one stock rail 9 to a location outside the other stock rail 9. The bellows tube 10*a* is inserted into the loop in the cylindrical members 13*a* of the embedded fixing devices 13, and the bolts 13*c* and the nuts 13*d* are tightened so that the bellows tube 10*a* is securedly fixed to the cylindrical members 13*a*. Then, the respective L-shaped rods 13*b* are embedded in the ground so that the bellows tube 10*a* is secured to the ground.

One end of each of the lubricant feeding tubes 8 is connected to the distributing valve 8*a*. One of the tubes 8 is taken out from the bellows tube 10*a* at an intermediate location and is coupled to one of the subsidiary distributing valve 8*b* nearer to the lubricant supply apparatus 1. The other lubricant feeding tube 8 goes out at the remote end of the bellows tube 10*a* and is coupled to the other subsidiary valve 8*b*.

The terminal lubricant feeding tubes 8*c* are inserted into the respective bellows tubes 10. The bellows tubes 10 are disposed outside the respective stock rails 9 and extend in parallel with the stock rails 9. Similar to the bellows tube 10*a*, the bellows tubes 10 are secured to the ground by the fixing members 13.

The top piece 14*b* of each of the tube holders 14 is nailed to the tie 7. Each terminal lubricant feeding tube 8*c* is held by the holding portion 14*c*. Thus, each terminal tube 8*c* is fixed along the length of each tie 7.

The horizontal piece 14*b* of each fixing member 15 is securedly nailed to the upper surface of one of the ties 7 at a location near one of the floor plates 2 on it. The distal end of each terminal lubricant feeding tube 8*c* is inserted into the cylindrical member 15*c* in the vertical piece 15*b*, so that the distal end of the terminal lubricant feeding tube 8*c* is at a level above the floor plate.

The tube holders 14 and the fixing members 15 are secured to the ties 2 by hammering nails 16 and 16*a* into the ties 2 from above the top pieces 14*b* and the horizontal pieces 15*a*, respectively. Accordingly, the mounting of the terminal lubricant feeding tubes 8*c* is simple.

Different from the previously described prior art apparatus, the lubricant supply apparatus 1 can be installed in existing turnouts in a simple manner because it is not necessary to attach any detecting means to detect the sliding of the tongue rails 3.

Figure 13:
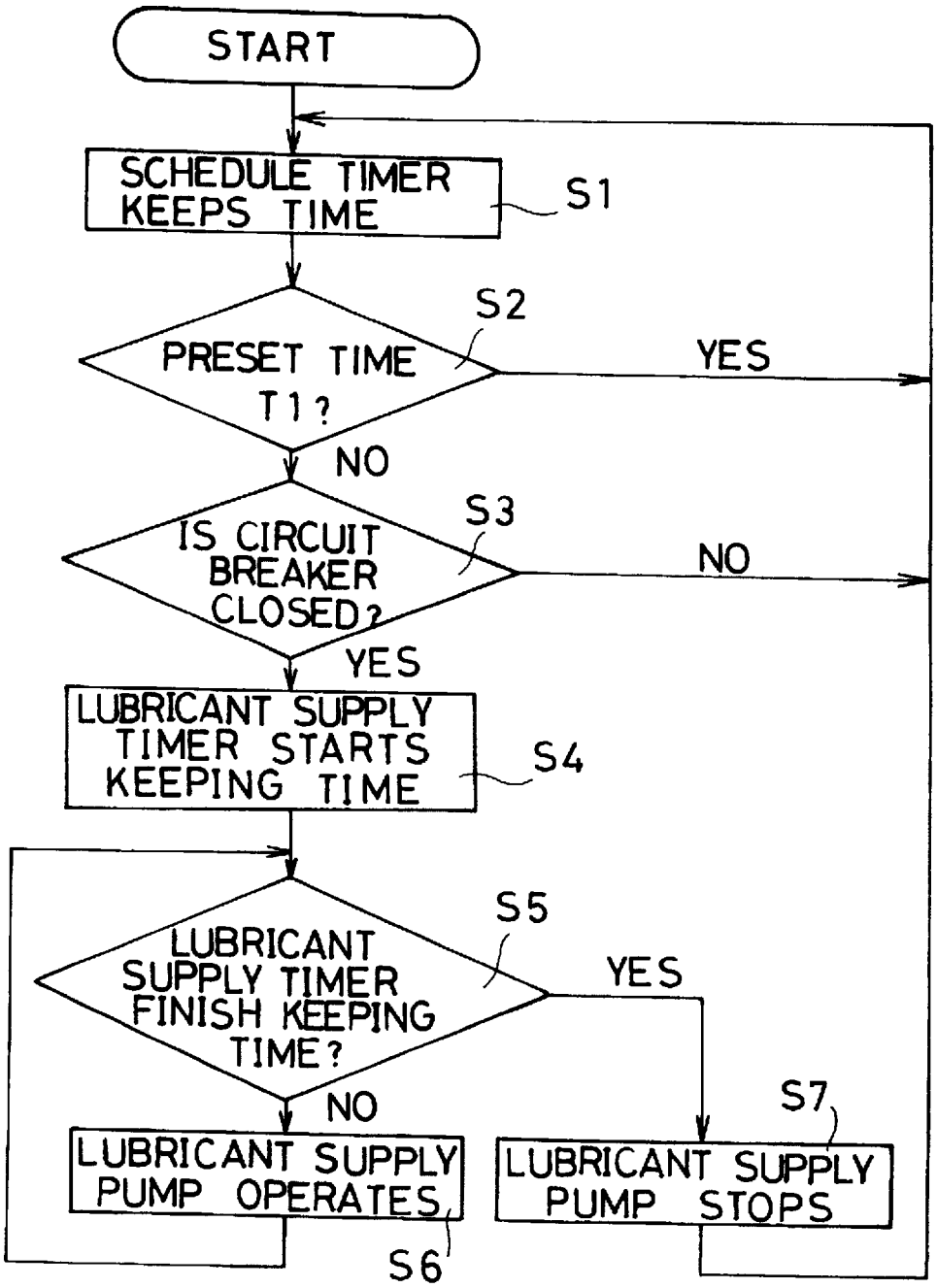
FIG. 13 is a flow chart of the operation of the lubricant supply apparatus shown in FIG. 1.

The lubricant supply apparatus 1 according to the present invention operates in a manner as shown, for example, in FIG. 13.

The schedule timer 5 keeps time (Step 1), and determines when the time is a preset time T1 at which the lubricant supply pump should start operation (Step 2). If it is not the preset time T1, Steps 1 and 2 are repeated until it becomes the preset time T1. When it becomes the time T1, the schedule timer 5 checks the circuit breaker 4*b* as to whether it is closed or open (Step S3). If the circuit breaker 4*b* is open, the process returns to Step S1. When the circuit breaker 4*b* is closed, the schedule timer 5 causes the lubricant supply timer 6 to start operating (Step 4). The lubricant supply timer 6 determines whether the time which the timer 6 is measuring has reached a predetermined time length, e.g. a preset lubricant supply time T2 (Step 5). When the preset lubricant supply time T2 has not lapsed, the lubricant supply timer 6 causes the supply of AC power to the lubricant supply pump 4 to be continued (Step 6), and the process returns to Step 5. When the preset lubricant supply time lapses, the lubricant supply timer 6 causes the AC power to be decoupled from the pump 4 (Step 7). Then, the process returns to Step 1. Then, the operation start time is switched to another preset time, and the schedule timer 5 repeats the above-described operation with the new preset time.

In the above-described embodiment, separate timers are used as the schedule timer 5 and the lubricant supply timer 6, but the schedule timer 5 and the lubricant supply timer 6 may be realized in a single micro-computer.

The lubricant supply apparatus 1 supplies lubricant to the floor plates 2 at each preset time, regardless of the number of the slidings of the tongue rails 3. Accordingly, even if the sliding time interval is long and the rain falls to wash out the lubricant on the floor plates 2, the lubricant is supplied without fail at preset times. Thus, sufficient amount of lubricant is present whenever the tongue rails 3 slide.

The time length in the lubricant supply timer 6 during which lubricant is supplied to the floor plates can be varied, and, therefore, the amount of lubricant to be supplied by the lubricant supply pump 4 at a time can be adjusted. Thus, an appropriate amount of lubricant can be always supplied onto the floor plates 2, depending on the frequency of the sliding of the tongue rails 3.

The preset times in the schedule timer 5 can be set such that the operation start times of the lubricant supply pump 4 coincide with the times when the tongue rails 3 are to slide, so that the amount of lubricant consumed can be saved. If lubricant is supplied onto the floor plates 2 between one sliding and the next of the tongue rails 3, it is possible that the lubricant may be washed away by the rain and, therefore, an insufficient amount of lubricant is left when the tongue rails 3 actually slide. In order that a sufficient amount of lubricant is present whenever the tongue rails 3 move, lubricant must be supplied onto the floor plates 2 very frequently, which increases the amount of lubricant to be used. In contrast, by scheduling the supply of lubricant for the times when the tongue rails 3 slide, the lubricant on the floor plates 2 is neither insufficient nor excessive.

The preset times in the schedule timer 5 can be such that the lubricant supply pump 4 starts operating at times different from the times when the tongue rails 3 are to slide. For example, in areas where the amount of rain is small, lubricant supplied from a relatively narrow path like the terminal lubricant supply tube 8*c* to a relatively small area on each floor plate 2 can spread over the floor plate during a time interval between one and next slidings of the tongue rails 3. This prevents localized abrasion of the floor plates and the tongue rails 3.

The preset times in the schedule timer 5 can be such that the lubricant supply pump 4 starts operating at times immediately before the tongue rails 3 are to slide. In this case, lubricant supplied from the relatively narrow paths of the terminal lubricant feeding tubes 8*c* to relatively small areas on the floor plates 2 can spread over the floor plates 2 as the tongue rails 3 slide. This prevents localized abrasion of the floor plates 2 and the tongue rails 3. If the rain falls before the tongue rails 3 slide and lubricant has been already supplied to the floor plates 2, it may be possible that the lubricant is washed away when the tongue rails 3 are to slide. However, according to the aspect of the present invention, because lubricant is supplied just before the tongue rails 3 slide, only little lubricant is washed away.

Alternatively, the preset times in the schedule timer 5 can be such that the lubricant supply pump 4 starts operating at times immediately after the times when the tongue rails 3 are to slide. In this case, when the tongue rails 3 slide at short intervals, lubricant can spread over the floor plates 2 due to frequent sliding of the tongue rails, which prevents localized abrasion of the tongue rails 3 and the floor plates 2.

Because the battery is provided in the schedule timer 5 in order to keep the schedule timer 5 operating even when power supply to the apparatus is interrupted. Thus, there is no need for providing separate means for supplying power to the schedule timer 5, such as power supply wires, for continuously operating the schedule timer 5. This enables the lubricant supply apparatus of the present invention to be readily installed for existing turnouts.

The lubricant supply apparatus 1 has been described as being used with a turnout which includes a pair of stock rails and a pair of tongue rails. However, the present invention is also applicable to a turnout for a monorail system which includes one stock rail and one tongue rail.

What is claimed is:

1. A lubricant supply apparatus for supplying lubricant between at least one row of a plurality of spaced-apart floor plates and at least one tongue rail disposed on said floor plates in such a manner as to slide on said floor plates;

a pump for discharging said lubricant;

first timer means in which a time of day at which said pump is to start operating is preset, said first timer means developing an output at said preset time of day; and second timer means responsive to said output of said first timer means to cause said pump to operate for a predetermined time period.

2. The lubricant supply apparatus according to claim 1 wherein a plurality of such times of day are preset in said first timer means.

3. The lubricant supply apparatus according to claim 1 wherein said time of day preset in said first timer means is a time of day at which said tongue rail is to slide on said floor plates.

4. The lubricant supply apparatus according to claim 1 wherein said time of day preset in said first timer means is a time of day different from a time of day at which said tongue rail is to slide on said floor plates.

5. The lubricant supply apparatus according to claim 1 wherein said time of day preset in said first timer means is a time of day immediately before a time of day at which said tongue rail is to slide on said floor plates.

6. The lubricant supply apparatus according to claim 1 wherein said time of day preset in said first timer means is a time of day immediately after a time of day at which said tongue rail is to slide on said floor plates.

7. The lubricant supply apparatus according to claim 1 wherein said first timer means is provided with a battery for enabling said first timer means to continue to operate when power supply thereto is interrupted.

* * * * *

UNITED STATES PATENT AND TRADEMARK OFFICE

CERTIFICATE OF CORRECTION

| | | |
|---|---|---|
| PATENT NO. | : | 5,842,543 |
| DATED | : | December 1, 1998 |
| INVENTOR(S) | : | Hiroyuki Naito and Masao Omori |

It is certified that error appears in the above-identified patent and that said Letters Patent is hereby corrected as shown below:

Title page, first column, line 5 after [73] Assignee: Nabco Limited, Kobe Japan, insert --Kinki Nippon Railway Company, Limited, Osaka, Japan--.

Signed and Sealed this

Thirty-first Day of August, 1999

*Attest:*

Q. TODD DICKINSON

*Attesting Officer*

*Acting Commissioner of Patents and Trademarks*